US008888244B2

(12) United States Patent
Kang et al.

(10) Patent No.: US 8,888,244 B2
(45) Date of Patent: Nov. 18, 2014

(54) INKJET PRINTING APPARATUS AND METHOD OF FORMING NOZZLES

(75) Inventors: Sung-gyu Kang, Suwon-si (KR); Young-ki Hong, Anyang-si (KR); Joong-hyuk Kim, Seoul (KR); Seung-ho Lee, Suwon-si (KR); Jae-woo Chung, Yongin-si (KR); Yong-wan Jin, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 5 days.

(21) Appl. No.: 13/477,383

(22) Filed: May 22, 2012

(65) Prior Publication Data

US 2013/0135392 A1 May 30, 2013

(30) Foreign Application Priority Data

Nov. 25, 2011 (KR) ..... 10-2011-0124391

(51) Int. Cl.
*B41J 2/14* (2006.01)

(52) U.S. Cl.
USPC ..... 347/47

(58) Field of Classification Search
CPC .. B41J 2/04525; B41J 2/1412; B41J 2/14129; B41J 2/14137; B41J 2/1433; B41J 2/1606; B41J 2/1404; B41J 2/14145; B41J 2/1628; B41J 2/1629
USPC ..... 347/47, 68, 72
See application file for complete search history.

(56) References Cited

U.S. PATENT DOCUMENTS

| | | | | |
|---|---|---|---|---|
| 4,169,008 | A | 9/1979 | Kurth | |
| 4,282,533 | A | 8/1981 | Brooks et al. | |
| 5,790,151 | A * | 8/1998 | Mills | 347/47 |
| 5,825,385 | A * | 10/1998 | Silverbrook | 347/56 |
| 6,250,740 | B1 * | 6/2001 | Moghadam et al. | 347/48 |
| 6,273,552 | B1 * | 8/2001 | Hawkins et al. | 347/48 |
| 6,511,156 | B1 * | 1/2003 | Kazama et al. | 347/47 |
| 6,533,197 | B1 * | 3/2003 | Takeuchi et al. | 239/596 |
| 7,690,766 | B2 * | 4/2010 | Ueno et al. | 347/55 |
| 7,914,127 | B2 * | 3/2011 | Martina et al. | 347/71 |
| 2001/0024219 | A1 * | 9/2001 | Kanda et al. | 347/47 |
| 2006/0061622 | A1 * | 3/2006 | Suzuki | 347/47 |
| 2006/0209127 | A1 * | 9/2006 | Inoue | 347/47 |
| 2009/0147049 | A1 * | 6/2009 | Lee et al. | 347/47 |
| 2009/0295870 | A1 * | 12/2009 | Goin et al. | 347/47 |
| 2011/0132872 | A1 * | 6/2011 | Van De Sande et al. | 216/57 |
| 2013/0063529 | A1 | 3/2013 | Hong et al. | |

FOREIGN PATENT DOCUMENTS

| | | | |
|---|---|---|---|
| KR | 2007-0040395 | A | 4/2007 |
| KR | 2008-0073129 | A | 8/2008 |
| KR | 2010-0043392 | A | 4/2010 |

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

A printing apparatus includes a first nozzle substrate having a first tapered nozzle unit aligned with a pressure chamber and a second nozzle substrate having a second tapered nozzle unit aligned with the first tapered nozzle unit and attached to the bottom of the first nozzle substrate.

9 Claims, 10 Drawing Sheets

INKJET PRINTING APPARATUS AND METHOD OF FORMING NOZZLES

CROSS-REFERENCE TO RELATED APPLICATIONS

This application claims the benefit of Korean Patent Application No. 10-2011-0124391, filed on Nov. 25, 2011, in the Korean Intellectual Property Office, the entire disclosure of which is incorporated herein by reference.

BACKGROUND

1. Field

Example embodiments relate to inkjet printing apparatuses and/or methods of forming nozzles of inkjet printing apparatuses.

2. Description of the Related Art

Recently, the use of inkjet technology is expanding from graphic printing to other fields, such as industrial printable electronics, displays, biotechnologies, and biosciences. This increase in popularity is due, in part, to the unique direct patterning characteristics of inkjets. Using inkjet technology, it is possible to remarkably reduce expenses because patterns may be formed with fewer operations than in a photolithography process. Also, inkjet technology may provide advantages over a photolithography process in manufacturing, for example, an electronic circuit where a non-flat or flexible substrate may be required.

Thus, a high precision and high resolution printing technology is required to apply inkjet technology to display fields or printing electronic engineering fields. Related art inkjet devices employ a nozzle having a diameter of several micrometers or less so as to discharge minute droplets of several picoliters to several femtoliters. Since a size of the nozzle is minute, even a slight change in nozzle dimensions affects uniformity, and as the size of the nozzle is decreased, pressure drop at the outlet of the nozzle is increased. As a result, in related art devices, droplets may not be discharged in a desired size or in a desired direction or, if performance limitations of an actuator are exceeded, droplets may not be discharged at all. Thus, inkjet apparatuses and methods of forming an inkjet apparatuses that achieve increased droplet uniformity are important to the field.

SUMMARY

Example embodiments provide an inkjet printing apparatus for discharging uniform droplets and/or a method of forming a nozzle for the inkjet printing apparatus.

According to at least one example embodiment, an inkjet printing apparatus includes: a path substrate having a pressure chamber; a nozzle substrate formed below the path substrate and having a nozzle for discharging ink; and an actuator providing driving force for discharging ink in the pressure chamber through the nozzle, wherein the nozzle substrate includes: a first nozzle substrate having a first tapered nozzle unit aligned with the pressure chamber; and a second nozzle substrate formed below the first nozzle substrate and having a second tapered nozzle unit aligned with the first tapered nozzle unit, wherein the nozzle has a tapered shape.

In at least one example embodiment, the first and second nozzle substrates may be attached to each other.

In at least one example embodiment, a thickness of the second nozzle substrate may be thinner than a thickness of the first nozzle substrate.

In at least one example embodiment, the inkjet printing apparatus may further include a trench formed around the nozzle and indented upward from a bottom surface of the second nozzle substrate. An outlet of the nozzle may extend into the trench. A nozzle wall forming a boundary of the nozzle and the first and second nozzle substrates may extend into the trench. The first and second nozzle substrates may be each a single crystal silicon substrate and the nozzle wall may be formed of silicon dioxide ($SiO_2$).

In at least one example embodiment, the actuator may include a piezoelectric actuator providing a pressure change to discharge ink in the pressure chamber. The actuator may include an electrostatic actuator providing electrostatic driving power to ink in the nozzle.

According to at least one other example embodiment, an inkjet printing apparatus includes: a pressure chamber; a first nozzle substrate having a first tapered nozzle unit aligned with the pressure chamber; and a second nozzle substrate having a second tapered nozzle unit aligned with the first tapered nozzle unit and bonded to the bottom of the first nozzle substrate.

In at least one example embodiment, the inkjet printing apparatus may further include: a trench indented from a bottom surface of the second nozzle substrate around the second tapered nozzle unit; and a nozzle wall forming a boundary of the first and second tapered nozzle units and the first and second nozzle substrates, wherein the nozzle wall extends into the trench.

In at least one example embodiment, the first and second tapered nozzle units may have a quadrangular pyramid shape.

According to at least one example embodiment, a method of forming a nozzle of an inkjet printing apparatus includes: forming a first indent portion having a tapered shape of which a sectional area gradually decreases through a first wafer; forming a second indent portion having a tapered shape of which a sectional area gradually decreases on a top surface of a second wafer; attaching the first and second wafers such that the first and second indent portions align with each other in a vertical direction; and forming a nozzle penetrating through the first and second wafers using the first and second indent portions by removing a desired (or alternatively, predetermined) thickness of the second wafer from the bottom surface of the second wafer such that the second indent portion penetrates through the second wafer.

In at least one example embodiment, a depth of the second indent portion may be shallower than a depth of the first indent portion.

In at least one example embodiment, the forming of the first indent portion may include forming a mask layer having an opening at a portion where the first indent portion is to be formed on the first wafer of which a crystal orientation of the top surface is <100> orientation, and etching the first wafer in a vertical direction using a wet type anisotropic etching process. A shape of the opening may be circular.

In at least one example embodiment, the forming of the first indent portion may include forming a mask layer having an opening at a portion where the first indent portion is to be formed, on the first wafer, and etching the first wafer in a vertical direction using a dry type taper etching process.

In at least one example embodiment, the forming of the second indent portion may include forming a mask layer having an opening at a portion where the second indent portion is to be formed on the second wafer of which a crystal orientation of the top surface is <100> orientation, and etching the second wafer in a vertical direction by using a wet type anisotropic etching process such that the second wafer is not penetrated.

In at least one example embodiment, a method of forming an inkjet apparatus may further include: forming a wall layer at least on the bottom surface of the second wafer and the inner wall surfaces of the first and second indent portions; exposing surroundings of the nozzle on the bottom surface of the second wafer by patterning the wall layer formed on the bottom surface of the second wafer; and forming a trench indented from the bottom surface by etching the exposed bottom surface of the second wafer such that at least a part of the wall layer formed on the second indent portion is exposed by using the wall layer as an etch mask.

In at least one example embodiment, the first and second wafers may be each a single crystal silicon wafer. The wall layer may be formed of silicon dioxide ($SiO_2$). The wall layer may be formed by oxidizing the single crystal silicon wafer.

BRIEF DESCRIPTION OF THE DRAWINGS

Example embodiments will become apparent and more readily appreciated from the following description of the accompanying drawings in which.

DETAILED DESCRIPTION OF EXAMPLE EMBODIMENTS

Figure 1:
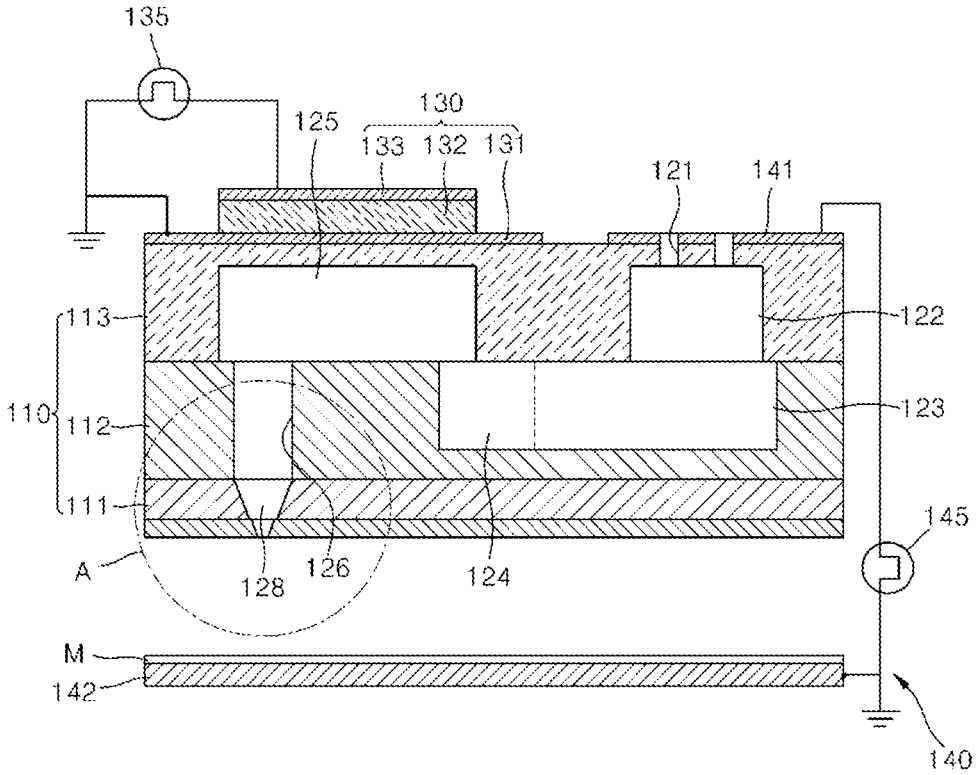
FIG. 1 is a cross-sectional view of a schematic diagram illustrating an inkjet printing apparatus according to at least one embodiment.

Example embodiments will now be described more fully with reference to the accompanying drawings, in which some example embodiments are shown. In the drawings, the thicknesses of layers and regions are exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may be embodied in many alternate forms and should not be construed as limited to only those set forth herein.

It should be understood, however, that there is no intent to limit this disclosure to the particular example embodiments disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of this disclosure. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Spatially relative terms, such as "below", "beneath", "lower", "above", "upper", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 1 is a cross-sectional view schematically illustrating an inkjet printing apparatus according to an example embodiment. FIG. 1 shows a path plate 110 and an actuator providing driving power for discharging ink. The actuator may be a composite-type actuator including a piezoelectric actuator 130 and an electrostatic actuator 140 providing a piezoelectric driving force and an electrostatic driving force. Alternatively, a structure of a nozzle or trench described below may also be applied to an inkjet printing apparatus that uses one of a piezoelectric method and an electrostatic method.

An ink path and a plurality of nozzles 128 for discharging ink droplets are formed in the path plate 110. The ink path may include an ink inlet 121 into which ink flows, and a plurality of pressure chambers 125 containing the ink. The ink inlet 121 may be formed on the top surface of the path plate 110, and may be connected to an ink tank (not shown). Ink supplied from the ink tank flows into the path plate 110 through the ink inlet 121. The pressure chambers 125 are formed in the path plate 110, and store ink that has flowed through the ink inlet 121. Manifolds 122 and 123 and a restrictor 124, which connect the ink inlet 121 and the pressure chambers 125, may be formed inside the path plate 110. The nozzles 128 are connected to the pressure chambers 125 in a one-to-one manner. The ink filled in the pressure chambers 125 is discharged in droplets through the nozzles 128. The nozzles 128 may be formed on the bottom surface of the path plate 110, and may be arranged in at least one row. A plurality of dampers 126 connecting the pressure chambers 125 and nozzles 128 may be provided in the path plate 110.

The path plate 110 may be formed of a substrate having satisfactory micro-processability, such as a silicon substrate. For example, the path plate 110 may include a path forming substrate where an ink path is formed and a nozzle substrate 111 where the nozzle 128 is formed. The path forming substrate may include first and second path forming substrates 113 and 112. The ink inlet 121 may penetrate through the first path forming substrate 113 at the top of the path plate 110, and the pressure chambers 125 may have a desired (or alternatively, predetermined) depth from the bottom surface of the first path forming substrate 113. The nozzles 128 may penetrate through a substrate at the bottom of the path plate 110, i.e., the nozzle substrate 111. The manifolds 122 and 123 may be respectively formed in the first and second path forming substrates 113 and 112. The dampers 126 may penetrate the second path forming substrate 112. Three substrates that are sequentially stacked, i.e., the first path forming substrate, 113, the second path forming substrate 112, and the nozzle substrate 111 may be attached to each other via silicon direct bonding (SDB).

A shape of the ink path formed inside the path plate 110 is not limited to the one shown in FIG. 1, and may vary.

According to at least one example embodiment, the piezoelectric actuator 130 provides a piezoelectric driving force to discharge ink, i.e., provides a pressure change in the pressure chambers 125. The piezoelectric actuator 130 is formed on the top surface of the path plate 110 at a location corresponding to the pressure chamber 125. The piezoelectric actuator 130 may include a lower electrode 131, a piezoelectric film 132, and an upper electrode 133, which are sequentially stacked on the top surface of the path plate 110. The lower electrode 131 operates as a common electrode, and the upper electrode 133 operates as a driving electrode that applies a voltage to the piezoelectric film 132. A piezoelectric voltage applying unit 135 applies a piezoelectric driving voltage to the lower and upper electrodes 131 and 133. The piezoelectric film 132 is transformed by the piezoelectric driving voltage applied from the piezoelectric voltage applying unit 135, thereby transforming the first path forming substrate 113 to form an upper wall of the pressure chamber 125. The piezoelectric film 132 may be formed of a desired piezoelectric material, such as a lead zirconate titanate (PZT) ceramic material.

The electrostatic actuator 140 provides an electrostatic driving force to ink inside the nozzle 128, and may include a first electrostatic electrode 141 and a second electrostatic electrode 142, which face each other. An electrostatic voltage applying unit 145 applies an electrostatic driving voltage between the first and second electrostatic electrodes 141 and 142.

According to at least one example embodiment, the first electrostatic electrode 141 may be prepared on the path plate 110. The first electrostatic electrode 141 may be formed on the top surface of the path plate 110, i.e., on the top surface of the first path forming substrate 113. In at least one example embodiment, the first electrostatic electrode 141 may be disposed in an area where the ink inlet 121 is formed so as to be spaced apart from the lower electrode 131 of the piezoelectric actuator 130. The second electrostatic electrode 142 may be spaced apart from the bottom surface of the path plate 110. A print medium M, on which ink droplets discharged from the nozzles 128 of the path plate 110 are printed, may be disposed on the second electrostatic electrode 142.

The electrostatic voltage applying voltage 145 may apply an electrostatic driving voltage in a pulse form. The second electrostatic electrode 142 is grounded in FIG. 1. Alternatively, the first electrostatic electrode 141 may be grounded. The electrostatic voltage applying unit 145 may apply an electrostatic driving voltage in a direct current (DC) voltage form. Here, the first or second electrostatic electrode 141 or 142 may be grounded. A location of the first electrostatic electrode 141 is not limited to the location shown in FIG. 1. Although not illustrated, the first electrostatic electrode 141 may be formed inside the path plate 110. For example, the first electrostatic electrode 141 may be formed on the bottom surfaces of the pressure chamber 125, restrictor 124, and/or manifold 123. Alternatively, the first electrostatic electrode 141 may be disposed at any location inside the path plate 110. For example, the first electrostatic electrode 141 may be formed only on the bottom surface of the pressure chamber 125, or formed on the bottom surface of the restrictor 124, or formed on the bottom surface of the manifold 123. Also, the first electrostatic electrode 141 may be integrally formed with the lower electrode 131.

Figure 2:
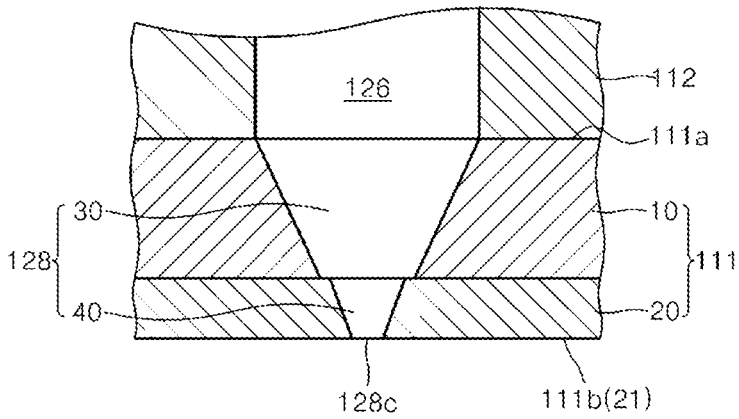
FIG. 2 is a detailed view of a portion A of FIG. 1.

FIG. 2 is a more detailed view of a portion A of FIG. 1. Referring to FIG. 2, the nozzle 128 is formed through the nozzle substrate 111. The nozzle 128 has a tapered or tiered shape of which a section area of the nozzle 128 gradually decreases toward a bottom surface 111*b* of the nozzle substrate 111. The nozzle substrate 111 may include a first nozzle substrate 10 and a second nozzle substrate 20 disposed below the first nozzle substrate 10. The nozzle 128 penetrates through the first and second nozzle substrates 10 and 20. Alternatively, the nozzle 128 may have a tiered shape with at least two tiers created by the first and second nozzle substrates.

According to at least one example embodiment, the nozzle 128 may include a first nozzle unit 30 formed in the first nozzle substrate 10, and a second nozzle unit 40 formed in the second nozzle substrate 20. The first nozzle unit 30 communicates with the pressure chamber 125 through the damper 126 prepared in the second path forming substrate 112, and has a tapered shape of which a section area gradually decreases toward the second nozzle unit 40. The second nozzle unit 40 communicates with the first nozzle unit 30, and has a tapered shape of which a sectional area gradually decreases toward an outlet 128*c*. A thickness of the second nozzle substrate 20 may be thinner than a thickness of the first nozzle substrate 10 so as to decrease (or alternatively, prevent) deterioration of nozzle uniformity by decreasing a process time of etching the second nozzle substrate 20 to form the second nozzle unit 40 as described below.

According to at least one example embodiment, the first and second nozzle substrates 10 and 20 may be silicon (Si) substrates. As described below, the first and second nozzle units 30 and 40 may be formed via an anisotropic etching process of a silicon substrate having a crystal orientation of <100>. The first and second nozzle substrates 10 and 20 and the first and second nozzle units 30 and 40 may be bonded to each other via a silicon direct bonding (SDB) method. A SBD method may be performed so as to form the nozzle substrate 111 having the nozzle 128 that penetrates through the entire nozzle substrate 111 in a tapered fashion, where a sectional area of the nozzle 128 gradually decreases from a top surface 111*a* to the bottom surface 111*b* of the nozzle substrate 111.

Figure 3A:
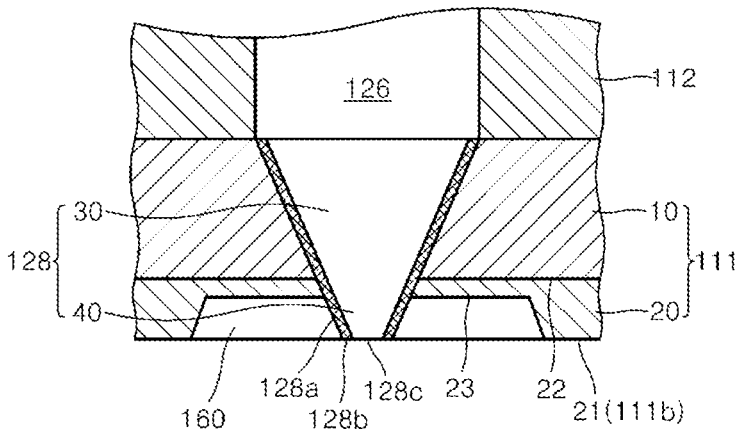
FIG. 3A is a detailed view of a printing apparatus including a trench, according to at least one example embodiment.

Referring to FIG. 3A, a trench 160 indented from the bottom surface 111*b* of the nozzle substrate 111, i.e., from a bottom surface 21 of the second nozzle substrate 20, may be formed around the nozzle 128. A nozzle wall 128*a* forms an outer wall of the nozzle 128. The nozzle wall 128*a* forms a boundary between the nozzle substrate 111 and the nozzle 128. The nozzle wall 128*a* extends from the inside of the nozzle substrate 111 into the trench 160, and thus the overall shape of the nozzle 128 is sharp or pointed and the outlet 128*c* of the nozzle 128 extends into the trench 160 toward the bottom surface 111*b*.

Still referring to FIG. 3A, the second nozzle substrate 20 has a stepped surface 23 stepped from the bottom surface 21 to a top surface 22. The nozzle 128 penetrates through the stepped surface 23 in a tapered shape. The nozzle wall 128*a* forms the boundary between the nozzle substrate 111 and the nozzle 128, and extends toward the bottom surface 21 across the stepped surface 23 while maintaining the tapered shape. An end 128*b* and the outlet 128*c* of the nozzle wall 128*a* may not exceed the bottom surface 21 of the second nozzle substrate 20. Alternatively, the end 128*b* and the outlet 128*c* of the nozzle wall 128*b* may extend beyond the bottom surface 21 of the second nozzle substrate 20.

Still referring to FIG. 3A, the nozzle 128 may be a cone shape with a circular cross-section, or the nozzle 128 may have a polypyramid shape with a polygonal cross-section. According to at least one example embodiment, the nozzle 128 having a quadrangular pyramid shape may be formed by anisotropic etching of a single crystal silicon substrate. If the sectional shape of the nozzle 128 is polygonal, an effective diameter of the nozzle 128 may be indicated in a diameter of an equivalent circle.

The nozzle wall 128*a* may be formed of a different material from the nozzle substrate 111, such as SiO2, SiN, Ti, Pt, or Ni. Alternatively, the nozzle wall 128*a* may be formed of the same material as the nozzle substrate 111, such as Si.

Figure 4A:
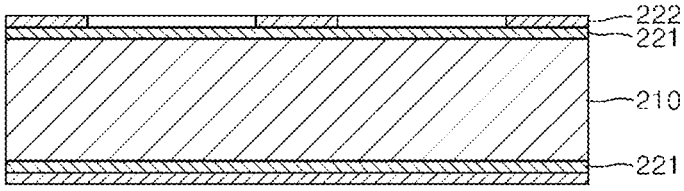
FIGS. 4A through 4N are views illustrating a method of forming a nozzle according to example embodiments, such as a nozzle having a shape shown in FIGS. 2 and 3A.

A method of forming the nozzle 128 according to at least one example embodiment will now be described in detail with reference to FIGS. 4A through 4N.

Figure 4B:
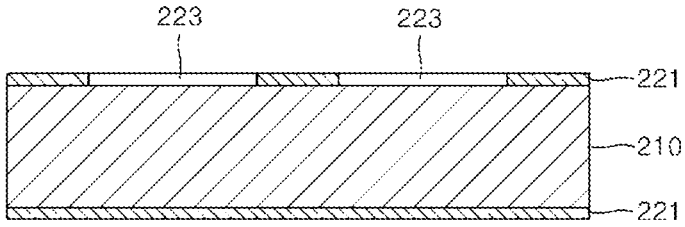

An etch mask is formed on one surface of a first wafer 210. For example, FIG. 4A shows a first wafer 210 may be a silicon single crystal wafer having a thickness of about 140 μm and a crystal orientation of the top surface being <100>. Then, a mask layer 221 is formed. The mask layer 221 may be a SiO2 layer. The SiO2 layer may be formed by oxidizing the first wafer 210. Next, a photoresist layer 222 is formed on the mask layer 221, and a part of the mask layer 221 is exposed by patterning the photoresist layer 222 via, for example, a lithography method. As shown in FIG. 4B, when the mask layer 221 is patterned using the photoresist layer 222 as a mask, the mask layer 221 is formed and has an opening 223 at a portion where the first nozzle unit 30 is to be formed. The mask layer 221 may be formed by a wet type etching process using a buffered hydrogen fluoride acid (HF solution).

A shape of the opening 223 may be circular and may have a diameter of about 220 μm. According to at least one example embodiment, a crystal orientation of the first wafer 210 and a mask pattern may not be aligned during a wet type anisotropic etching when a mask layer 221 having the circular opening 223 is formed. However, a nozzle formed in accordance with at least one example embodiment may decrease (or alternatively, prevent) non-uniformity of nozzles 128, which occurs due to alignment errors between the first wafer 210 and a mask layer having a rectangular opening.

Figure 4C:
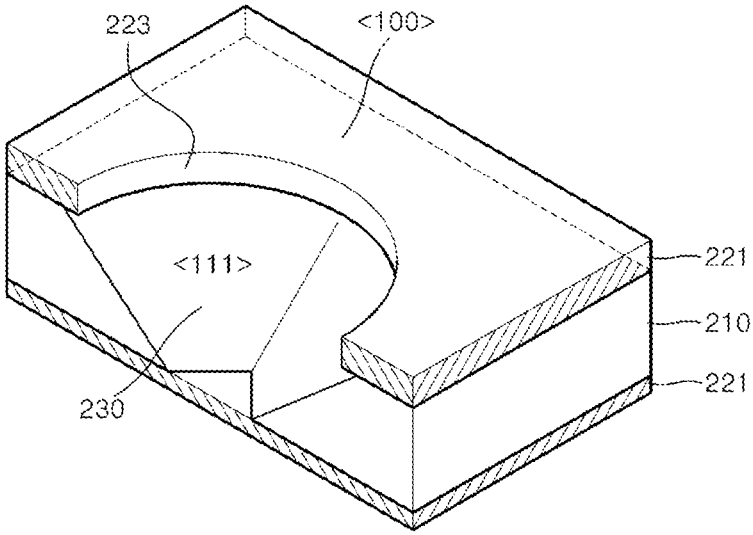
Figure 4D:
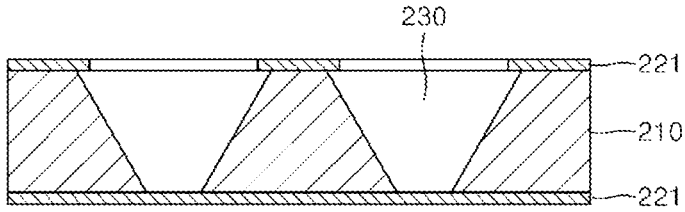

According to at least one example embodiment, the first wafer 210 is etched by using the mask layer 221 as an etch mask. The etching may be performed via a wet type anisotropic etching process using 90° C., 20% tetramethyl ammonium hydroxide (TMAH). Here, an etching rate is about 0.8 to about 0.9 μm/min. Referring to FIG. 4C, the crystal orientation of the top surface of the first wafer 210 may be <100>, and the crystal orientation of a surface where etching is performed may be <111>. Due to a difference in etching rates between the <100> and <111> orientations, etching is quickly performed downward but slowly performed sideways as shown in FIGS. 4C and 4D. Accordingly, a first indent portion 230 having a tapered shape of which a sectional area decreases downward is formed on the first wafer 210. In other words, the first indent portion 230 has a quadrangular pyramid shape (inverted pyramid shape) of which a cross section is quadrangular. The etching is stopped by the mask layer 221 formed on the bottom surface of the first wafer 210. Since slight under etching occurs at the outside of the opening 223, the top of the first indent portion 230 having the quadrangular pyramid shape may not be completely inscribed in the opening 223 having the circular shape.

Figure 4E:
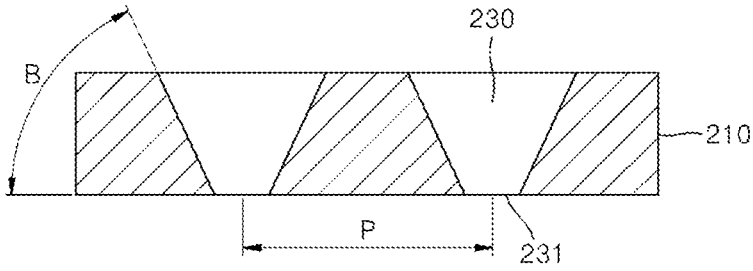

As shown in FIG. 4E, the mask layer 221 formed on top and bottom surfaces of the first wafer 210 is removed via a process, such as etching or polishing. A buffered oxide etchant (BOE) may be used for etching. Accordingly, the first indent portion 230 is formed, which penetrates through the first wafer 210 and has a quadrangular pyramid shape and a sectional area that gradually decreases.

Figure 4F:
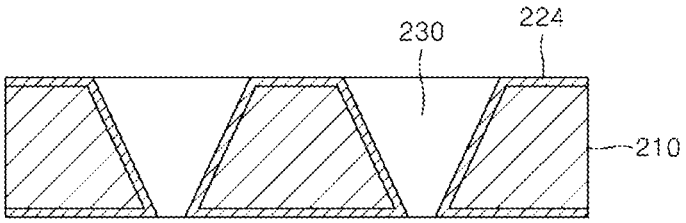

As shown in FIG. 4F, a protection layer 224 is formed on an exposed surface of the first wafer 210 and includes at least an inner wall surface of the first indent portion 230. The protection layer 224 may be a SiO2 layer obtained by oxidizing the first wafer 210.

A process for forming the first indent portion 230 may be performed via a dry type taper etching process instead of the wet type anisotropic etching process described above. According to at least one example embodiment, an angle B (FIG. 4E) of the first indent portion 230 may differ depending upon which processes are used. For example, the angle B may be about 54.7° according to the wet type anisotropic etching process, and may be about 60 to 70° according to the dry type taper etching process. In other words, the angle B is higher when the dry type taper etching process is used than when the wet type anisotropic etching process is used. An interval P between the first indent portions 230 represents an interval between the nozzles 128 manufactured according to at least one example embodiment. Resolution may be improved by narrowing the interval between the nozzles 128 using the dry type taper etching process.

Figure 4G:
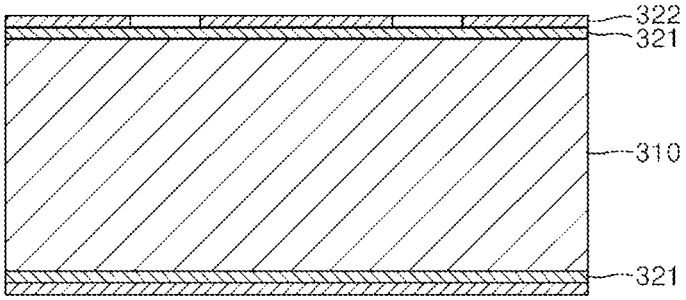
Figure 4H:
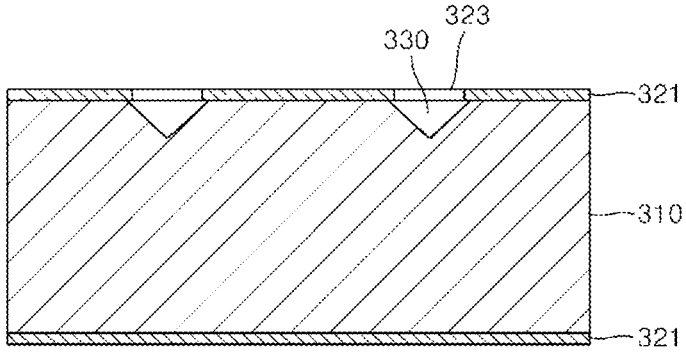

Next, as shown in FIG. 4G, a second wafer 310 is prepared using a silicon single crystal wafer having a thickness of about 650 μm and a top surface of having a crystal orientation of <100>. Then, a mask layer 321 is formed. The mask layer 321 may be a SiO2 layer. The SiO2 layer may be formed by oxidizing the second wafer 310. Then, a photoresist layer 322 is formed on the mask layer 321, and a part of the mask layer 321 is exposed by patterning the photoresist layer 322 via, for example, a lithography method. When the mask layer 321 is patterned by using the photoresist layer 322 as a mask, the mask layer 321 having an opening 323 (a portion where the second nozzle unit 40 is to be formed) may be formed as shown in FIG. 4H. A process of patterning the mask layer 321 may be formed via a wet type etching process using a HF solution. The opening 323 may have a circular shape. A diameter of the opening 323 may be smaller than a diameter of the opening 223 for forming the first indent portion 230 shown in FIG. 4B. The diameter of the opening 323 may be suitably formed depending on a diameter of an outlet 231 of FIG. 4E. A diameter of the outlet 231 may be determined when the diameter of the opening 223 and the thickness of the first wafer 210 are determined because the etching angle of the first wafer 210 during anisotropic etching is about 54.7°.

Referring to FIG. 4H, the second wafer 310 is etched using the mask layer 321 as an etch mask. The second wafer 310 may be etched via an anisotropic etching process using TMAH. A second indent portion 330 having a tapered shape is formed in the second wafer 310 using the same etching process as described above, with reference to FIG. 4C. In more detail, the top of the second indent portion 330 having a quadrangular pyramid shape may not be completely inscribed in the opening 323 having a circular shape since slight under etching occurs at the outside of the opening 323 In at least one example embodiment, the second indent portion 330 does not penetrate all the way through the second wafer 310. Also, an etch depth of the second indent portion 330 may be shallower than an etch depth of the first indent portion 230.

Figure 4I:
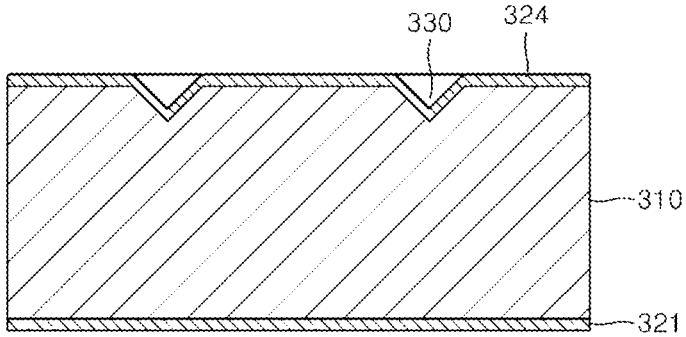

The mask layer 321 formed on the top and bottom surfaces of the second wafer 310 is removed by a process, such as etching or polishing. Also, as shown in FIG. 4I, a protection layer 324 is formed on an exposed surface of the second wafer 310 which includes at least an inner wall surface of the second indent portion 330. The protection layer 324 may be a SiO2 layer obtained by oxidizing the second wafer 310.

Figure 4J:
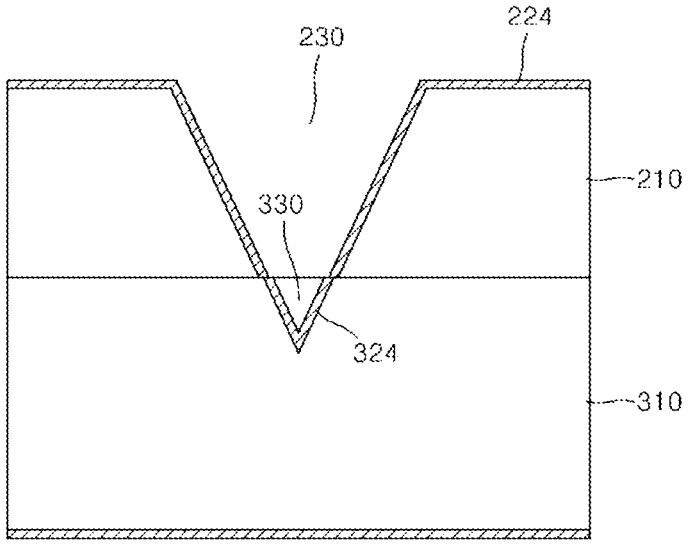

Then, as shown in FIG. 4J, the first and second wafers 210 and 310 are attached to each other by using, for example, a SDB method. Alignment marks (not shown) for attaching the first and second wafers 210 and 310 are pre-prepared, and the first and second wafers 210 and 310 are attached based on the alignment marks such that the first and second indent portions 230 and 330 are aligned with each other. The protection layers 224 and 324 formed on the bottom surface of the first wafer 210 and the top surface of the second wafer 310 may be removed before attaching.

Figure 4K:
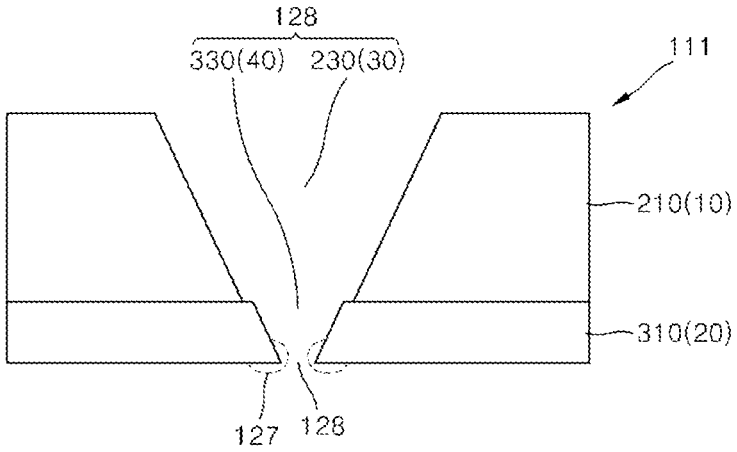

Next, FIG. 4K shows removing a desired (or alternatively, predetermined) thickness from the bottom of the second wafer 310 such that the second indent portion 330 creates an opening in the bottom surface of the second wafer 310. The removal process may be performed by a mechanical polishing process or a combined process of a mechanical polishing process and an etching process using BOE. During the removal process, the protection layers 224 and 324 may prevent the first and second indent portions 230 and 330 from being damaged.

Still referring to FIG. 4K, once the protection layers 224 and 324 are removed, the nozzle 128 is formed by the first and second nozzle units 30 and 40. An inkjet printing apparatus according to example embodiments may be manufactured by attaching the nozzle substrate 111 of FIG. 4K to the path forming substrate of FIG. 1, to the bottom surface of the second path forming substrate 112.

Figure 4L:
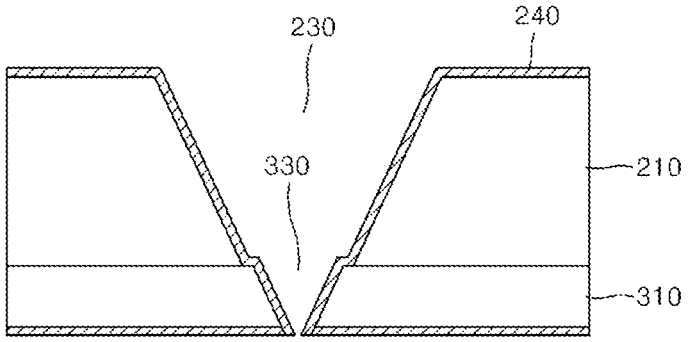
Figure 4M:
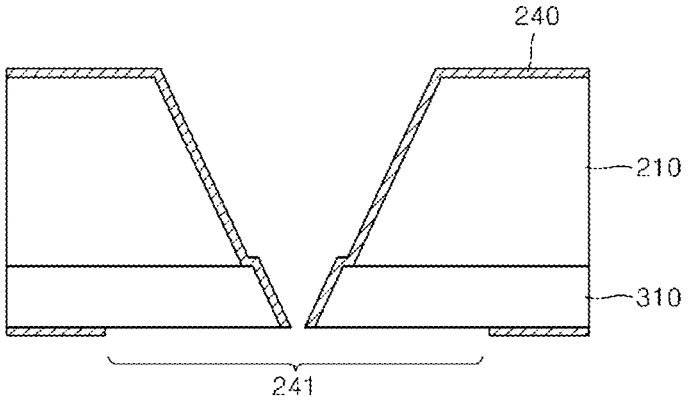
Figure 4N:
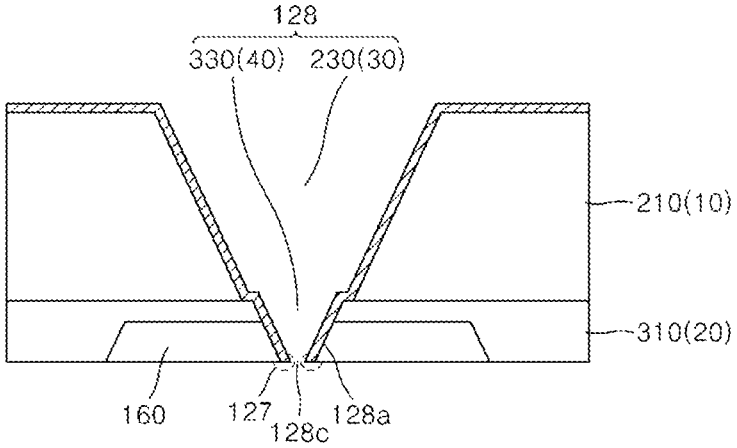

FIGS. 4L-4N describe a process of forming the trench 160 and the nozzle wall 128*a* that forms the boundary between the nozzle 128 and the first and second wafers 210 and 310 according to at least one example embodiment.

Referring to FIG. 4L, a wall layer 240 is formed on at least the exposed surfaces of the first and second wafers 210 and 310 including the inner wall surface of the first and second indent portions 230 and 330 and the bottom surface of the second wafer 310 from the structure shown in FIG. 4K. The wall layer 240 may be a SiO2 layer. Here, the wall layer 240 may be formed by oxidizing the first and second wafers 210 and 310. Alternatively, the wall layer 240 may be formed by coating, plating, or depositing SiN, Ti, Pt, or Ni. A thickness of the wall layer 240 may be from about 100 to about 10,000 Å.

Then, as shown in FIG. 4M, a part 241 of the wall layer 240 at the bottom surface of the second wafer 310 is removed. In other words, a portion where the trench 160 is to be formed is defined by removing the wall layer 240 around the second indent portion 330 at the bottom surface of the second wafer 310. Part 241 is formed by coating photoresist on the wall layer 240, patterning the photoresist to expose an area corresponding to the part 241 of the wall layer 240, and etching the wall layer 240 by using the patterned photoresist as a mask.

Next, as shown in FIG. 4N, the trench 160 is formed by etching the bottom surface of the second wafer 310 using the wall layer 240 as an etch mask. The wall layer 240 formed on the wall surface of the first and second indent portions 230 and 330 becomes the nozzle wall 128*a*, and the outlet 128*c* extends into the trench 160 toward the bottom surface of the second wafer 310.

The structure of FIG. 4N corresponds to FIG. 3A, where the nozzle substrate 111 includes the nozzle 128 having the tapered shape of which the sectional area gradually decreases toward the bottom surface 111*b* of the nozzle substrate 111, the nozzle wall 128*a* forming the boundary of the nozzle substrate 111 and the nozzle 128, and the trench 160 indented from the bottom surface 111*b* of the nozzle substrate 111 around the nozzle 128.

When an anisotropic etching process is used to form the nozzle 128 having a tapered shape on a single silicon substrate, as in related art methods and devices, a very long etching time is required for the nozzle 128 to penetrate through the entire silicon substrate. A crystal defect may exist in the silicon substrate, which may cause different etching rates and may deteriorate uniformity of shapes and sizes of nozzles. Also, nozzle uniformity may be deteriorated as hydrogen bubbles generated during the etching process are temporarily adsorbed to the surface of the silicon substrate.

According to the inkjet printing apparatus of at least one example embodiment, the first and second nozzle units 30 and 40 are respectively formed on the first and second substrates 10 and 20, and the first and second substrates 10 and 20 are attached to each other. A inkjet printing apparatus formed according to at least one example embodiment may reduce etching times for forming the first and second nozzle units 30 and 40 on the first and second nozzle substrates 10 and 20. Further, crystal defects that occur during the etching process may be reduced. As such, nozzle uniformity may be increased because a temporary adsorption of hydrogen bubbles generated during the etching process may be reduced. Thus, a cross sectional shape near the outlet 128*c* of the nozzle 128 may have an increased uniform square shape.

According to at least one example embodiment, an overall thickness of the nozzle substrate 111 may be about 165 μm, wherein the thickness of the first nozzle substrate 10 is about 140 μm and the thickness of the second nozzle substrate 20 is about 25 μm.

In conventional or related art devices and methods, if the nozzle 128 is formed on a single silicon single crystal wafer having a thickness of about 165 μm by using an anisotropic etching process, an etching time is about 3 hours and 30 minutes, which is very long. Furthermore, etching uniformity may deteriorate due to adsorption of hydrogen gas during the etching process. It is also highly likely that a crystal defect will occur during etching.

However, according to at least one example embodiment, an etching depth near the outlet 128*c* of the nozzle 128 is about 25 μm, and an etching time is only about 30 minutes. Thus, an etching time is reduced and it is easy to obtain etching uniformity during the etching process. As a result of greater etching uniformity, the shape of the outlet 128*c* of the nozzle 128 may be an almost uniform square shape.

Table 1 below shows widths and lengths of nozzle outlets manufactured on one substrate according to related art methods. Table 2 shows the same categories of data as Table 1, except that the nozzles in Table 2 were formed according to at least one example embodiment. Referring to Table2, uniformities ((maximum value−minimum value)/(maximum value+minimum value)) of widths and lengths of the outlets 128*c* of nozzles 128 formed according to at least one example embodiment are about 12% and 10%, respectively. Thus, nozzles formed according to at least one example embodiment exhibit length and width uniformities that are remarkably higher when compared to the uniformities of conventional nozzles, which only achieve width and length uniformities of 35% and 49%, respectively. Also, uniformities of effective diameters of the outlets 128*c* of the nozzles 128 formed according to at least one example embodiment are about 10%, and thus higher compared to conventional nozzles, which have diameter uniformities of about 32%. Furthermore, oblong factors (OF), which show the shapes of the outlets 128*c* of the nozzles 128, are almost 0% Table 2. This means that the nozzles 128 manufactured according to at least one example embodiment have an approximately square pyramid shape whereas nozzles manufactured according to related art methods have larger oblong factors and have more non-uniformity.

TABLE 1

| Nozzle no. | Width (μm) | Length (μm) | Effective diameter (μm) | OF (%) |
|---|---|---|---|---|
| 1 | 1.9 | 1.2 | 1.4 | 48.7 |
| 3 | 1.3 | 1.2 | 1.2 | 9.1 |
| 4 | 1.5 | 1.4 | 1.4 | 7.8 |
| 4 | 1.5 | 1.1 | 1.2 | 33.3 |
| 5 | 1.7 | 1.5 | 1.6 | 13.3 |
| 6 | 1.8 | 2.1 | 1.9 | 16.5 |
| 7 | 1.2 | 1.2 | 1.2 | 0 |
| 8 | 1.5 | 1.3 | 1.4 | 15.4 |
| 9 | 1.5 | 1.2 | 1.3 | 24.4 |
| 10 | 1.7 | 1.3 | 1.4 | 28.6 |
| 11 | 1.9 | 1.7 | 1.8 | 11.8 |
| 12 | 1.5 | 1.3 | 1.4 | 15.4 |
| 13 | 1.4 | 1.3 | 1.3 | 7.6 |
| 14 | 1.6 | 1.3 | 1.4 | 21.9 |
| 15 | 1.8 | 1.4 | 1.5 | 26.8 |
| 16 | 1.4 | 1.8 | 1.5 | 26.8 |
| 17 | 1.8 | 1.5 | 1.6 | 19.1 |
| 18 | 1.4 | 1.4 | 1.4 | 0 |
| 19 | 1.6 | 1.9 | 1.7 | 18.5 |
| 20 | 2.0 | 3.2 | 2.4 | 45.1 |
| 21 | 1.9 | 1.6 | 1.7 | 18.5 |
| 22 | 2.2 | 1.9 | 2.0 | 15.2 |
| 23 | 2.1 | 2.4 | 2.2 | 13.7 |
| 24 | 1.0 | 1.8 | 1.9 | 11.1 |
| 25 | 2.2 | 1.7 | 1.9 | 16.8 |
| 26 | 1.7 | 2.1 | 1.9 | 22.2 |
| 27 | 2.5 | 1.8 | 2.1 | 34.4 |
| 28 | 2.4 | 1.9 | 2.1 | 24.2 |
| 29 | 2.1 | 2.2 | 2.1 | 4.7 |
| 30 | 2.2 | 1.9 | 2.0 | 15.2 |
| Average | 1.8 | 1.6 | 1.7 | 19.2 |
| Standard deviation | 0.4 | 0.5 | 0.4 | 11.6 |
| Minimum value | 1.2 | 1.1 | 1.2 | 0 |
| Maximum value | 2.5 | 3.2 | 2.4 | 18.7 |
| Uniformity | 35% | 49% | 33% | |

TABLE 2

| Nozzle no. | Width (μm) | Length (μm) | Effective diameter (μm) | OF (%) |
|---|---|---|---|---|
| 1 | 1.7 | 1.7 | 1.7 | 0 |
| 3 | 1.5 | 1.5 | 1.5 | 0 |
| 4 | 1.6 | 1.7 | 1.6 | 6.8 |
| 4 | 1.8 | 1.7 | 1.7 | 5.8 |
| 5 | 1.6 | 1.6 | 1.6 | 0 |
| 6 | 1.9 | 1.8 | 1.8 | 6.0 |
| 7 | 1.7 | 1.8 | 1.7 | 5.8 |
| 8 | 1.7 | 1.6 | 1.6 | 6.8 |
| 9 | 1.8 | 1.7 | 1.7 | 5.8 |
| 10 | 1.8 | 1.8 | 1.8 | 0 |

TABLE 2-continued

| Nozzle no. | Width (μm) | Length (μm) | Effective diameter (μm) | OF (%) |
|---|---|---|---|---|
| 11 | 1.8 | 1.8 | 1.8 | 0 |
| 12 | 1.7 | 1.7 | 1.7 | 0 |
| 13 | 1.6 | 1.6 | 1.6 | 0 |
| 14 | 1.7 | 1.7 | 1.7 | 0 |
| 15 | 1.7 | 1.7 | 1.7 | 0 |
| 16 | 1.6 | 1.6 | 1.6 | 0 |
| 17 | 1.6 | 1.6 | 1.6 | 0 |
| 18 | 1.7 | 1.7 | 1.7 | 0 |
| 19 | 1.7 | 1.7 | 1.7 | 0 |
| 20 | 1.5 | 1.5 | 1.5 | 0 |
| 21 | 1.7 | 1.7 | 1.7 | 0 |
| 22 | 1.6 | 1.6 | 1.6 | 0 |
| 23 | 1.6 | 1.6 | 1.6 | 0 |
| 24 | 1.5 | 1.5 | 1.5 | 0 |
| 25 | 1.7 | 1.7 | 1.7 | 0 |
| 26 | 1.5 | 1.5 | 1.5 | 0 |
| 27 | 1.8 | 1.6 | 1.7 | 12.5 |
| 28 | 1.5 | 1.5 | 1.5 | 0 |
| 29 | 1.5 | 1.5 | 1.5 | 0 |
| 30 | 1.6 | 1.6 | 1.5 | 0 |
| Average | 1.6 | 1.6 | 1.6 | 1.6 |
| Standard deviation | 0.1 | 0.1 | 0.1 | 3.2 |
| Minimum value | 1.5 | 1.5 | 1.5 | 0 |
| Maximum value | 1.9 | 1.8 | 1.8 | 12.5 |
| Uniformity | 12% | 10% | 10% | |

As described above, the uniformities of shapes and sizes of the nozzles 128 are improved using a method according to example embodiments. An inkjet printing apparatus formed according example embodiments may employ a piezoelectric method, an electrostatic method, or a composite method thereof, which discharges minute droplets having uniform sizes.

At least one example embodiment describes forming an inkjet printing apparatus and using the composite method for discharging minute ink droplets. A composite method provides a piezoelectric driving force and an electrostatic driving force to ink, and may be driven in any one of various driving modes for discharging ink droplets in different sizes and shapes by controlling an application order, amplitude, and application duration of a piezoelectric driving voltage applied to the piezoelectric actuator 130 and an electrostatic driving voltage applied to the electrostatic actuator 140. For example, the inkjet printing apparatus may be driven in a dripping mode for discharging minute droplets having a size smaller than a size of a nozzle, a cone-jet mode for discharging minute droplets having a size smaller than that in the dripping mode, or a spray mode for discharging ink droplets in a jet stream form.

Figure 3B:
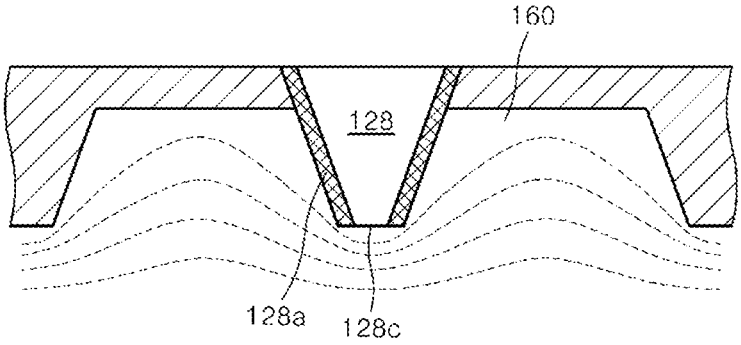
FIG. 3B is a view of equipotential lines around an outlet of a nozzle formed according to at least one example embodiment.

Referring to FIG. 3A, by forming the trench 160 around the nozzle 128 having the tapered shape, the nozzle 128 has an overall sharp or pointed shape. Generally, charges are concentrated at a pointed portion of the nozzle 128. Also, as shown in FIG. 3B, equipotential lines due to the electrostatic driving voltage may be concentrated near the outlet 128*c* of the nozzle 128 due to the trench 160. Thus a very large electric field may be formed near the outlet 128*c* of the nozzle 128, thereby increasing the electrostatic driving force at the outlet 128*c* of the nozzle 128. Accordingly, droplets may be very effectively accelerated, and sizes of droplets may be reduced under the given amplitude of the electrostatic driving voltage. Also, ultramicro ink droplets of several picoliters to several femcoliters may be stably discharged to the print medium M.

As such, since the piezoelectric driving method and the electrostatic driving method are used together, ink can be discharged in a drop on demand (DOD) method, and thus it is easy to control printing operations. Also, by using the nozzle 128 of which a sectional area gradually decreases toward the outlet 128*c* and has an overall sharp or pointed shape and by including the trench 160 around nozzle 128, it is easy to discharge micro droplets and improve straightness of discharged ink droplets, and thus increased printing precision may be achieved.

As shown in FIG. 4K, TEOS (Tetra Ethyl Ortho Silicate) oxide 127 may be disposed around the outlet 128*c* in order to decrease the diameter of the outlet 128*c* of the nozzle 128. At this time, although not shown in FIG. 4K, a mask exposing only the outlet 128*c* of the nozzle 128 may be formed at the bottom surface of the second wafer 310, and the TEOS oxide 127 may be deposited around the outlet 128*c*.

Such a process may also be applied to FIG. 4N, and the diameter of the outlet 128*c* may be further decreased by depositing the TEOS oxide 127 to the nozzle wall 128*a* near the outlet 128*c*.

While example embodiments have been particularly shown and described, it will be understood by one of ordinary skill in the art that variations in form and detail may be made therein without departing from the spirit and scope of the claims.

What is claimed is:

1. An inkjet printing apparatus comprising:

a path substrate including a pressure chamber;

a nozzle substrate below the path substrate and including a nozzle for discharging ink; and an actuator providing a driving force for discharging ink in the pressure chamber through the nozzle, the nozzle substrate including:

a first nozzle substrate having a first tapered nozzle unit aligned with the pressure chamber;

a second nozzle substrate below the first nozzle substrate and having a second tapered nozzle unit aligned with the first tapered nozzle unit, the first tapered nozzle unit and second tapered nozzle unit forming the nozzle such that the nozzle has a tapered shape; and a nozzle wall that forms a boundary of the nozzle and the first and second nozzle substrates, wherein, the second nozzle substrate has a stepped surface stepped from a bottom surface thereof toward a top surface thereof around the nozzle, the second tapered nozzle unit penetrates through the stepped surface, and the nozzle wall extends from an inside of the nozzle substrate toward the bottom surface of the second substrate across the stepped surface while maintaining the tapered shape to form an outlet of the nozzle at an end of the nozzle wall.

2. The inkjet printing apparatus of claim 1, wherein the first and second nozzle substrates are on each other.

3. The inkjet printing apparatus of claim 1, wherein a thickness of the second nozzle substrate is thinner than a thickness of the first nozzle substrate.

4. The inkjet printing apparatus of claim 1, wherein the first and second nozzle substrates are each a single crystal silicon substrate and the nozzle wall is formed of silicon dioxide ($SiO_2$).

5. The inkjet printing apparatus of claim 1, wherein the actuator includes a piezoelectric actuator providing a pressure change to discharge ink in the pressure chamber.

6. The inkjet printing apparatus of claim 5, wherein the actuator includes an electrostatic actuator providing electrostatic driving power to ink in the nozzle.

7. An inkjet printing apparatus comprising:

a path substrate including a pressure chamber and a damper communicating with the pressure chamber;

a nozzle substrate including a first nozzle substrate below the path substrate and a second nozzle substrate disposed below the first nozzle substrate;

a nozzle having a tapered shape, the nozzle including, a first tapered nozzle unit penetrating the first nozzle substrate and aligned with the pressure chamber via the damper, and a second tapered nozzle unit penetrating the second nozzle substrate and aligned with the first tapered nozzle unit; and a nozzle wall forming a boundary between the nozzle substrate and the nozzle, wherein, the second nozzle substrate has a stepped surface stepped from a bottom surface thereof toward a top surface thereof around the nozzle, the second tapered nozzle unit penetrates through the stepped surface, and the nozzle wall extends from an inside of the nozzle substrate toward the bottom surface of the second substrate across the stepped, surface while maintaining the tapered shape to form an outlet of the nozzle at an end of the nozzle wall.

8. The inkjet printing apparatus of claim 7, wherein the first and second tapered nozzle units have a quadrangular pyramid shape.

9. The inkjet apparatus of claim 7, wherein the tapered shape is such that a cross-sectional area of the nozzle continuously decreases toward the outlet of the nozzle.

* * * * *